United States Patent [19]

Zehren

[11] 4,438,996

[45] Mar. 27, 1984

[54] APPARATUS FOR USE IN ENERGIZING SUBMERGIBLE PUMPING EQUIPMENT IN UNDERWATER WELLS

[75] Inventor: James N. Zehren, Bartlesville, Okla.

[73] Assignee: TRW Inc., Cleveland, Ohio

[21] Appl. No.: 316,743

[22] Filed: Oct. 30, 1981

Related U.S. Application Data

[63] Continuation-in-part of Ser. No. 222,540, Jan. 5, 1981, abandoned.

[51] Int. Cl.[3] ..... H01R 13/453

[52] U.S. Cl. ..... 339/40; 166/65 R; 339/65; 339/75 R

[58] Field of Search ..... 339/15, 16 R, 16 C, 339/40, 42, 66 R, 66 M, 65, 117 R, 117 P, 75 R, 75 M; 166/65 R, 341

[56] References Cited

U.S. PATENT DOCUMENTS 2,207,477 7/1940 Blackmon ..... 339/66 R

FOREIGN PATENT DOCUMENTS 614674 12/1948 United Kingdom ..... 339/186 M

*Primary Examiner*—Neil Abrams

*Attorney, Agent, or Firm*—Shapiro and Shapiro

[57] ABSTRACT

Apparatus for energizing submergible pumping equipment in an underwater well comprises a suspension head for the equipment and an adapter spool associated with wellhead apparatus and in which the suspension head seats. The apparatus includes internal electrical contacts within the adapter spool and contacts carried by radially expandable slips on the suspension head for establishing electrical connection between an external power source and the supply cable for the equipment which is carried by the suspension head. When the head is seated in the spool, radially expanding movement of the slips brings the respective contacts into engagement. The apparatus further includes complementary alignment formations on the head and spool for properly orienting the head and the spool so that the respective contacts are in mutual angular alignment. A sliding door may be provided in the adaptor spool for covering the spool contacts when not in use, the door being raised by the slips when radially expanded, so as to expose the contacts.

9 Claims, 5 Drawing Figures

APPARATUS FOR USE IN ENERGIZING SUBMERGIBLE PUMPING EQUIPMENT IN UNDERWATER WELLS

This application is a continuation-in-part of U.S. application Ser. No. 222,540, filed Jan. 5, 1981, now abandoned.

BACKGROUND OF THE INVENTION

The invention relates to apparatus for use in energizing submergible pumping equipment in an underwater well.

The extensive world-wide demand for oil and gas has greatly stimulated the drilling and operating of underwater wells and consequently has also greatly stimulated the research into and development of equipment used for servicing such wells.

One area which has received attention relates to methods and means for efficiently installing pumping equipment in an underwater well. Such equipment may, for example, be suspended by means of a cable or a pipe string from a suspension head which seats in a spool forming part of the wellhead apparatus. Various suspension systems of this type have previously been proposed but tend to be somewhat complex due, inter alia, to the need for obtaining adequate sealing of the apparatus, and protection against well blow-outs. Further, the suspension systems generally need also include some means penetrating the spool, for connecting an external source of electrical power to the downwell pumping equipment. The electrical connections must be adequately sealed and protected.

One previously proposed system for suspending and energizing pumping equipment in an underwater well is disclosed in U.S. Pat. No. 3,638,732 issued February 1972 to Huntsinger. In this arrangement, establishment of the required electrical connections requires the services of a diver. My own U.S. Pat. No. 4,003,428 issued January 1977, and commonly assigned herewith, discloses an alternative system which does not require the services of a diver to complete the installation and therefore economizes at least in this aspect of the overall well servicing procedures.

It is clearly desirable to simplify the equipment utilized in underwater well pump installation systems and to economize in the installation procedures without sacrificing reliability and safety of operation. The present invention is directed towards this end.

One object of the invention is to provide apparatus for use in energizing pumping equipment in an underwater well which can be installed and withdrawn without requiring the services of a diver.

Another object of the invention is to provide apparatus for use in energizing pumping equipment in an underwater well in which critical moving parts of the apparatus can be removed and returned to the well surface when the well is to be serviced.

Yet another object of the invention is to provide apparatus for use in energizing pumping equipment in an underwater well which includes novel means for establishing electrical connections between an external power source and the downwell equipment.

Still another object of the invention is to provide apparatus for use in energizing pumping equipment in an underwater well which does not require penetration of the wellhead apparatus during installation.

A further object of the invention is to provide apparatus for use in energizing pumping equipment in an underwater well which does not require unique orientation of the suspension apparatus relative to a member in which it is suspended.

SUMMARY OF THE INVENTION

Apparatus in accordance with the invention for energizing submergible pumping equipment in an underwater well comprises a suspension head for the pumping equipment and an adapter spool in which the suspension head seats, the spool in use being attached to the wellhead production tree.

The spool preferably includes three electrical contacts circumferentially spaced around its interior wall, the contacts being formed on pins extending through the wall for connection to the conductors of an external 3-phase electrical supply cable. An axially slidable cylindrical sleeve or door within the spool may normally cover the contacts to protect them against the intrusion of foreign matter.

The suspension head preferably has three radially expandable slips each of which ride on a ramp and each of which carries on its outer surface an electrical contact formed at the end of one of the conductors of a 3-phase cable forming the power cable for the pumping equipment. The power cable may be part of a suspension cable by which the pumping equipment is suspended from the suspension head or may be associated with a pipe string that supports the pumping equipment. Below the slips, the suspension head may have a seating section adapted to register with a seating section in the spool to orient the head in the spool and angularly align the respective contacts.

In use, when the suspension head is seated in the spool, with the pumping equipment lowered into the well, the contact-covering door in the spool is lifted by radially expanding the slips, and continued expansion of the slips wedges the slip contacts into engagement with the spool contacts to make the electrical connection between the exterior power source and the pumping equipment supply cable. When the equipment is to be raised from the well, the contacts are disengaged by radially retracting the slips.

The invention will be further described by way of specific example with reference to the accompanying drawings.

DESCRIPTION OF PREFERRED EMBODIMENT

Figure 1:
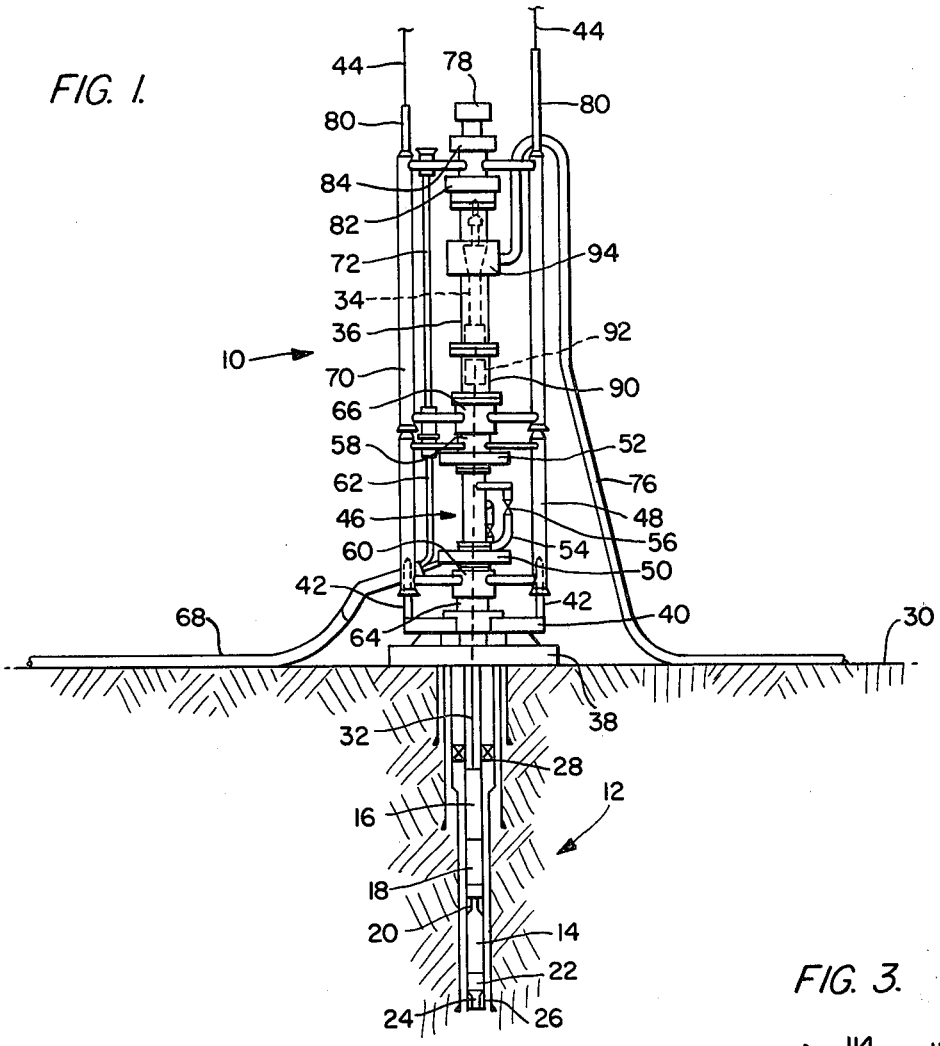
FIG. 1 is a somewhat diagrammatic elevation view of an underwater well, including wellhead apparatus.

As shown in FIG. 1, the invention may be employed in underwater wellhead apparatus 10 associated with an underwater well 12. The well itself may be conventional and include the usual casing and pipe strings. Suspended in the well (in a manner to be described) is submergible pump equipment, which may include a conventional submergible pump 14, an electric motor 16 for driving the pump, a protector 18, a packoff and lock 20 (isolating the inlet side of the pump from the discharge side), a hydraulic safety valve 22, and a valve actuator 24 for a mechanical isolation valve 26 at the bottom of an inner pipe string of the well. A vented annulus packer 28 may be employed between coaxial pipes as shown. The casings and pipe strings are shown diagrammatically and may be extended to the desired depth below the mud line or floor 30 of the body of water above the well. The pump and associated components may be suspended by a cable 32 (or alternatively by a pipe string) attached at its upper end to a suspension head 34 seated in a spool 36 of the wellhead apparatus. The suspension head and spool are shown in detail in FIGS. 2 and 3. At its lower end, spool 36 is connected to a housing 90 accommodating a packing assembly 92 for the suspension head (see FIG. 1).

The wellhead apparatus may also comprise a temporary guide base 40 with guide posts 42, guide cables 44 leading from the guide posts to buoys or a platform and a production tree 46 including a guide frame 48, a master valve 50, a full opening valve 52, flow lines 54, a wing valve 56, hydraulic connectors 58 and 60, and a hydraulic interconnect 62. Hydraulic connector 60 mates with a hydraulic connector 64 on the guide base, while hydraulic connector 58 mates with a hydraulic connector 66 connected to the bottom of housing 90. Elements of guide frame 48 mate with corresponding guide posts 42. Production tubing 68 leads from the production tree 46 to a remote platform or depot, for example.

Spool 36 and housing 90 are mounted on a guide frame 70, elements of which mate with elements of guide frame 48. A hydraulic interconnect 72 mates with the corresponding interconnect 62 of the production tree. The spool has a surrounding enclosure 94 which receives a 3-phase electrical supply cable 76 leading from an external power source. Electrical connection between cable 76 and a power cable leading to the pumping assembly is made through electrical contacts in spool 36 and suspension head 34 as will later be described. A full opening valve 82 may be provided above spool 36 directly under a hydraulic connector 84. A corrosion cap 78 may be provided at the top of the connector. Re-entry guide posts 80 extend upwardly from the guide frame 70 and guide cables 44 pass through the guide frames and guide posts in sequence.

Figure 3:
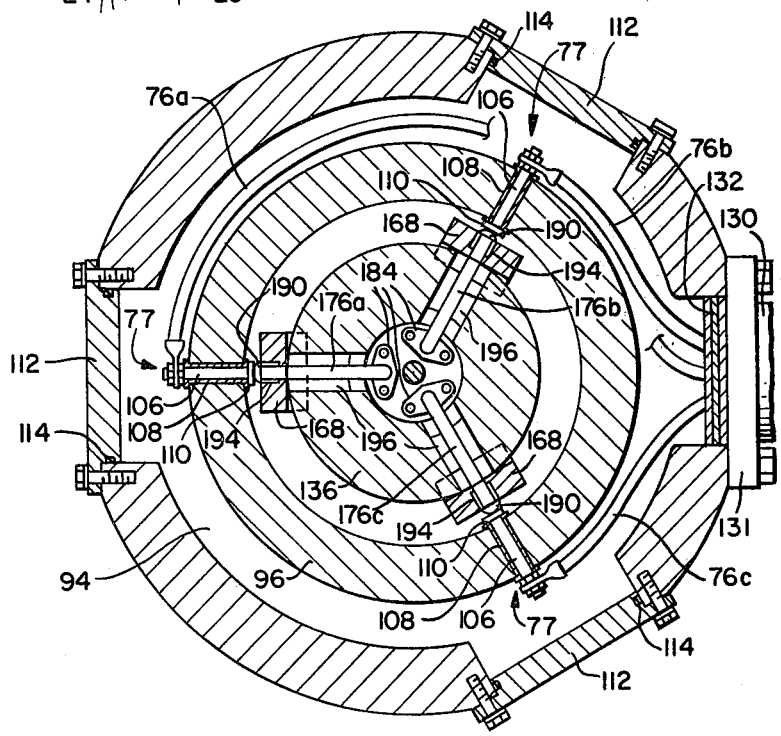
FIG. 3 is a sectional view on line 3—3 of FIG. 2.
Figure 2:
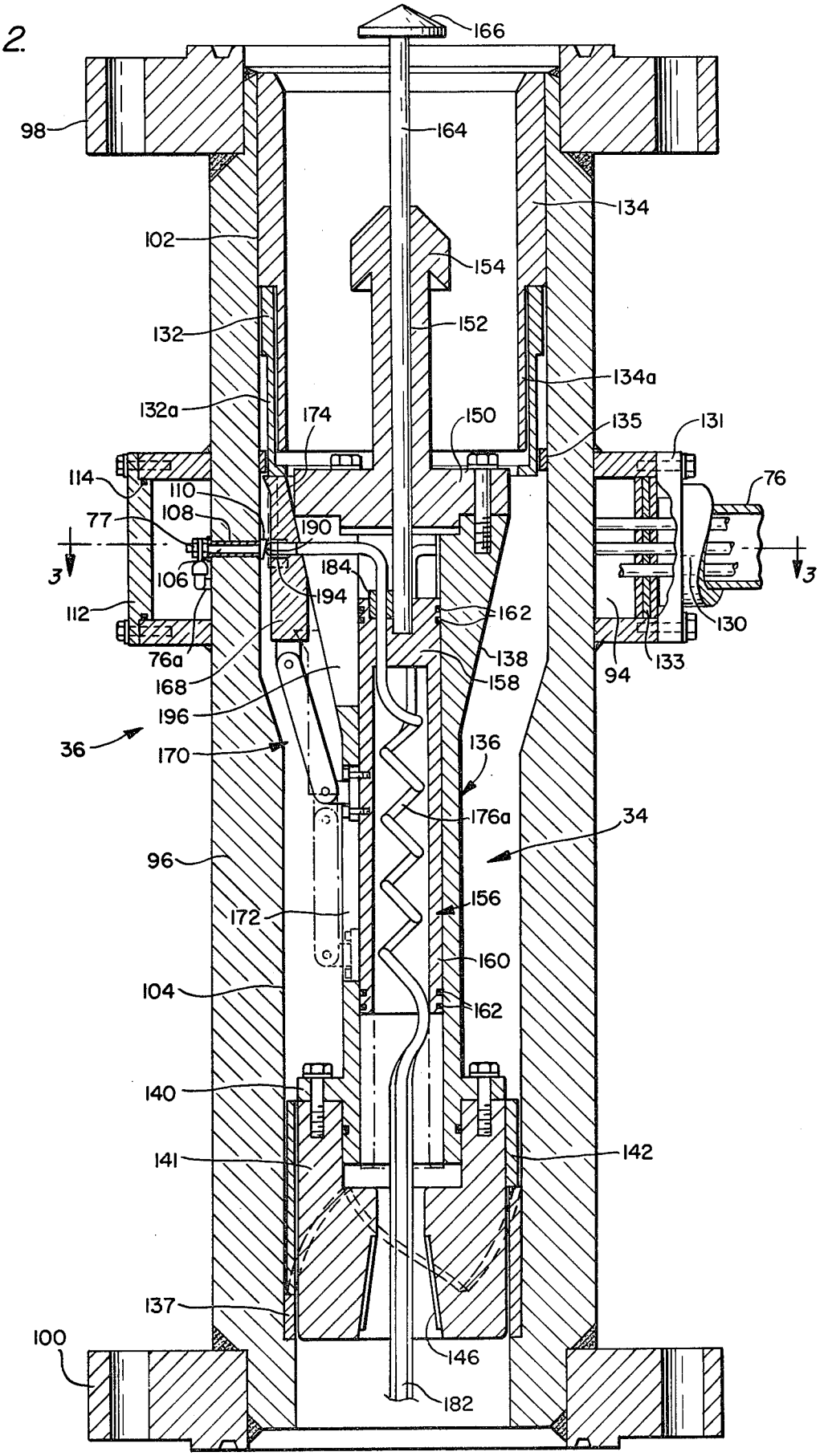
FIG. 2 is a sectional elevation of part of the wellhead apparatus, namely an adapter spool and suspension head which are the subject of the present invention.

As shown in greater detail in FIGS. 2 and 3, spool 36 comprises an elongate tubular casing 96, the upper and lower ends of which have welded flanges 98, 100 by which the spool is attached respectively to valve 82 and housing 90 (FIG. 1). Casing 96 has an internal wall having an upper section 102 and a reduced-diameter lower section 104. Near the bottom of section 102 the casing has three openings, equally circumferentially spaced apart, the openings each mounting a conductor pin 106 with suitable insulating sleeves 108 being interposed between the pins and their respective openings. Each of the pins terminates internally of casing 96 in a tapered contact head 110, and externally of the casing the pins are connected to the respective conductors **76*a*, 76*b* and 76*c* of supply cable 76, for example by eyelet and nut connections 77. The connections between the pins and the cable conductors are situated in the previously referred-to enclosure 94 which surrounds casing 96. The enclosure includes removable covers 112 and seals 114 for obtaining access to the respective connections. Cable 76 leads into enclosure 94 through a sealing chamber 130, a cover plate 131 and conductor seals 133**.

Internally of casing 96, above contacts 106, there is provided an axially sliding sleeve 132, a skirt portion **132*a* of which has clearance with respect to the contacts so as to form a door which covers the contacts when the sleeve 132 is in its lowered position. (The door is shown in FIG. 2 in its raised position, in which the contacts are exposed.) A further sleeve 134 is attached to the upper end of casing 96 and has a skirt 134*a* forming a guide for sleeve 132. A ring 135 may be provided on the wall of casing 96 to form a stop limiting downward movement of sleeve 132**.

At its lower end, casing 96 carries an internal alignment ring 137, the upper surface of which (as indicated in dashed line in FIG. 2), has three symmetrically disposed lobe portions adapted to mate with complementary lobe portions on the suspension head 34, as will be described, so as to orient the suspension head with respect to the casing and angularly align the respective contacts when the suspension head seats in the casing.

Suspension head 34 includes an elongate tubular body member 136, the upper portion of which has a conically tapered outer surface 138. Body member 136 has a flange 140 at its lower end, the flange being screwed to a hollow seating member 141. The seating member carries an outer ring 142 having a lower surface providing three lobes complementary to the lobes forming the upper surface of ring 137 in casing 96. Internally, seating member 141 has a female connecting portion 146 for attachment of the packing assembly 92 (FIG. 1). Packing assembly 92 may be of any convenient known form for providing protection of the suspension assembly against well fluids, by sealing against the interior of housing 90. The precise design of packing assembly 92 does not form part of the present invention, and the packing assembly may, for example, by of the type shown in my aforesaid U.S. Patent.

At its upper end, body member 136 is attached by screws or other fasteners to the flange 150 of an elongate hollow landing neck 152 having an enlarged tip 154 for engagement by the releasable jaws of any well known type of pulling and running tool used for lowering the suspension head into and lifting it from spool 36.

An electric contact carrier 156 is mounted for axial piston-like movement in the interior of body member 136, carrier 156 having a solid upper portion 158 and a hollow lower portion 160. O-ring seals 162 are interposed between the upper and lower portions of carrier 156 and the interior wall of body member 136. A fishing neck 164 extends from the top of carrier 156 through the interior of neck 152 and terminates in an enlarged head 166. Mounted on the lower portion 160 of carrier 156 are three equally circumferentially spaced slips 168, only one of which is shown in FIG. 2. The slips are attached to carrier 156 by pivotal linkages, as shown at 170, which extend through suitably aligned axially extending slits, as at 172, in body member 136. Tapered slip surfaces, as 174, are complementary to the conical outer surface 138 of body member 136 which forms a ramp for the slips, so that the slips can slide on surface 138 when carrier 156 is moved axially in body member 136, whereby the slips are radially expanded and retracted. The slips and surface 138 may have mating tracks and protrusions (not shown) to guide the slips' movement along the surface.

Interiorly, carrier 156 accommodates the three separated conductors **176*a*, 176*b* and 176*c* forming the terminal portion of a 3-phase power cable 182 for the downwell pumping equipment. The conductors are suitably bunched within carrier 156 to accommodate axial movement of the carrier. It will be understood that cable 182 extends downwardly through packing assembly 92 and may be attached in conventional manner, such as by a cable connector, to the pump suspension cable 32** which itself includes 3-phase supply conductors. Details of a suitable cable connector may be found, for example, in my aforesaid U.S. Patent.

Conductors 176*a*–176*c* are led out of carrier 156 through passages in upper portion 158 and insulator sleeves 184 having flanges screwed to the upper surface of the carrier. The ends of the conductors are accommodated in passages in the respective slips, and domed contact heads 190 are secured to the ends of the conductors, with the domed heads protruding from the outer slip surfaces. Insulating bushings 194 are interposed between the contact heads and the respective slip passages. The upper portion of body member 136 has axially extending slits 196, providing passage therethrough for the conductors.

It will be understood that the respective mating surfaces of alignment rings 137 and 142 and the angular positioning of the spool and suspension head contacts are such that when the rings are in mated engagement (in any one of three alternative positions due to the symmetrical lobe arrangement of the rings), the respective contacts will be accurately angularly aligned.

In use, the pumping equipment suspended from head 34 and the attached packing assembly 92, may be lowered into the well, after removal of cap 78 (FIG. 1) by conventional means, as for example described in my aforesaid U.S. Patent, with the jaws of a running tool releasably engaged to head 154. During the lowering operation, the suspension head slips are in the lower retracted position, as shown in phantom in FIG. 2 and sleeve 132 will be in its down position with door 132*a* covering the spool contacts 110. When alignment ring 142 engages and seats on ring 137, the symmetrical complementary lobe arrangement of the rings ensures that head 34 becomes properly oriented in spool 36 with the head and spool contacts in angular alignment. It will be noted that since the number of lobes on the alignment rings corresponds to the number of contacts on the spool and suspension head, unique alignment of the head and spool is not required and the head will be properly aligned in any one of three alternative angular positions.

After seating of the spool, packing assembly 92 may be set and the running tool disengaged from head 154. The jaws of the running tool are then engaged with tip 166 of fishing neck 164 in order to lift slip carrier 156 relative to body member 136. This action causes the slips to expand radially along the surface 138 and the upper edges of the slips to engage the lower rim of door 132*a*, thereby raising the door with continued slip travel and exposing the casing contacts 106. The relative dimensions of the various components are arranged such that further upward movement of the slips wedges the slip contacts into engagement with the casing contacts. The running tool can then be released from tip 166, pulled to the water surface and the wellhead capped. During operation of the pumping equipment, the slip and casing contacts are held in engagement by the wedging action of the slips between surface 138 and the interior of the spool.

When withdrawal of the pumping equipment from the well is required, after release of the downwell pack-off and of the packing assembly 92, a lifting force on head 154 by means of a suitable pulling tool, releases the wedging action of the slips, allowing them to retract along surface 138 so that the equipment can be lifted from the wellhead. This operation is accompanied by a lowering of door 132*a* by gravity to again cover the casing contacts.

Figure 4:
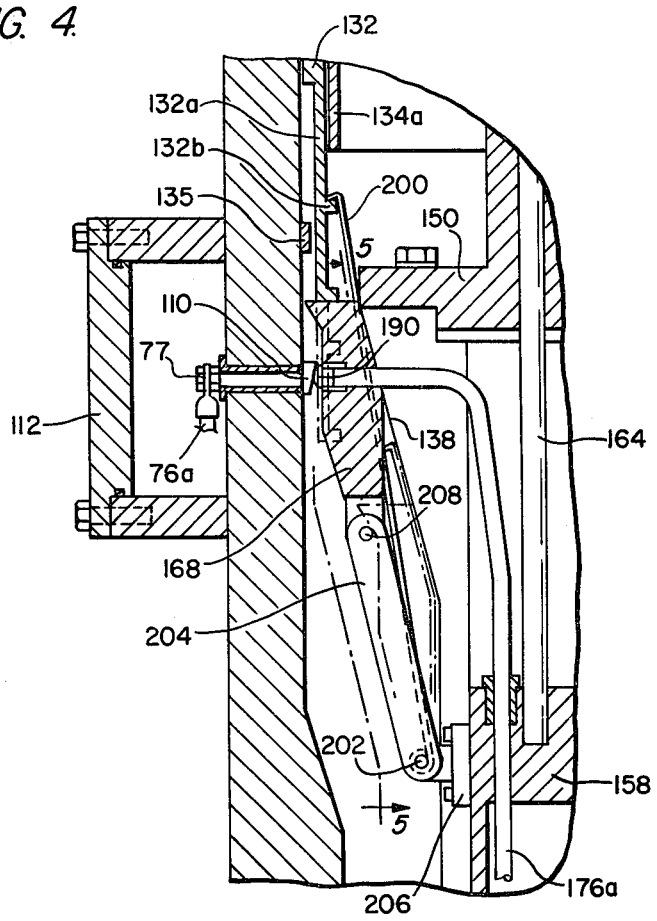
FIG. 4 is a fragmentary sectional elevation of part of an adapter spool and suspension head, similar to FIG. 2, but showing a modification.
Figure 5:
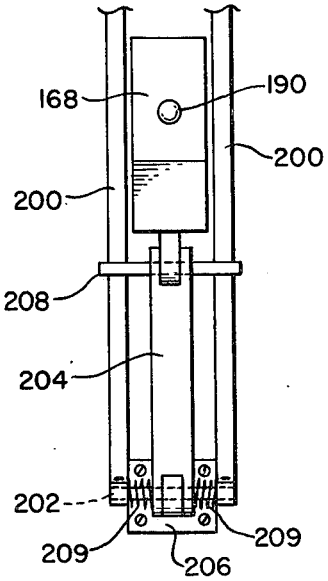
FIG. 5 is a view on line 5—5 of FIG. 4.

To provide more positive closure of door 132*a* when the equipment is withdrawn from the well, rather than relying on gravity to lower the door, the modification shown in FIGS. 4 and 5 may be employed.

In the arrangement of FIGS. 4 and 5, spring fingers 200 with hooked upper ends are pivotally secured on pin 202 which connects slip connecting link 204 to plate 206 by which the link is secured to carrier 156. At its upper end link 204 is connected to slip 168, as previously, by pin 208. As seen in FIG. 5, pin 208 is extended laterally and fingers 200 fit behind its opposite ends. The fingers are urged outwardly by springs 209 carried by pin 202.

When the slip is retracted, as shown in phantom in FIG. 4, fingers 200 are pressed by pin 208 against the tapered surface 138 of slip carrier 156, with their hooked upper ends projecting above the top of the slip. When the slip is raised, to raise door 132*a* and bring the electrical contacts into register, the fingers rise with the slip, straighten out when released by pin 208, and the hooked upper ends snap over a lip 132*b* or like projection of the interior of door 132*a*. Then, when the equipment is to be withdrawn, as previously described, the slip may be lowered, for example, by knocking on fishing head 166. This causes the hooked fingers to provide a positive downward pulling force on the door until the finger hooks are released from lip 132*b* when the fingers are pressed inwardly along surface 138 as the slip retracts.

The spring finger arrangement, as described above, may be replicated for each of the slips 168. In other respects, the construction of the suspension head and spool may be as previously described.

It will be seen from the above that the invention provides apparatus for energizing pumping equipment in an underwater well, which includes novel means for establishing electrical contact between an external power source and the downwell equipment, which apparatus can be installed and withdrawn from the water surface without requiring the services of a diver, and in which critical moving parts of the apparatus are withdrawn from the well and returned to the surface along with the pumping equipment.

While only preferred embodiments of the invention have been described herein in detail, the invention is not limited thereby and modifications can be made within the scope of the attached claims.

I claim:

1. Apparatus for energizing submergible pumping equipment in a well comprising a suspension head from which the equipment is adapted to be suspended and a casing adapted to be associated with wellhead apparatus for receiving the suspension head, the suspension head and casing having cooperable means for seating the head in the casing, the casing carrying at least one element for establishing electrical connection between an external power source and a supply cable for the equipment carried by the suspension head, the suspension head being inserted into the casing by motion along a line parallel to the casing longitudinal axis to a position past the said one element, the casing further including a sliding door for covering said element and the suspension head having a ramp and including means for sliding the door to a position exposing said element when the head is seated in the casing, with the sliding motion of said door being along a line substantially parallel to said casing longitudinal axis, said means for sliding including at least one radially expandable slip carried by the suspension head for axial movement along said ramp, said slip being positioned to engage said door and to move the door to expose said element during radially expanding movement of the slip along said ramp.

2. Apparatus as defined in claim 1, wherein said element comprises an electrical contact element and said slip carries a further electrical contact element associated with said supply cable, said contact elements being wedged into engagement by radially expanding movement of the slip along said ramp.

3. Apparatus for energizing submergible pumping equipment in a well comprising a suspension head from which the equipment is adapted to be suspended and a casing adapted to be associated with wellhead apparatus for receiving the suspension head, the suspension head and casing having cooperable means for seating the head in the casing, the casing carrying at least one element for establishing electrical connection between an external power source and a supply cable for the equipment carried by the suspension head, the casing further including a sliding door for covering said element and the suspension head having a ramp and including means for sliding the door to a position exposing said element when the head is seated in the casing, said means for sliding including at least one radially expandable slip carried by the suspension head for axial movement along said ramp, said slip being positioned to engage said door and to move the door to expose said element during radially expanding movement of the slip along said ramp, said means for sliding also including means for exerting a positive pulling force on the door for moving the door to cover said element responsive to radially retracting movement of the slip along said ramp from a position in which the element is exposed.

4. Apparatus as defined in claim 3, wherein the means for exerting a positive pulling force includes a finger carried for movement with the slip and having a hook portion adapted to engage a projection on the door when the slip moves to expose said element, the hook portion being released from said projection when the slip moves towards a fully retracted position.

5. Apparatus for energizing submergible pumping equipment in a well comprising a suspension head from which the equipment is adapted to be suspended and a casing adapted to be associated with wellhead apparatus for receiving the suspension head, the suspension head and casing having cooperable means for seating the head in the casing, the casing carrying at least one internal electrical contact element for establishing electrical connection between an external power source and a supply cable for the equipment carried by the suspension head, the suspension head having a ramp including a radially expandable and retractable slip adapted to move along said ramp, said supply cable terminating in an electrical contact carried by said slip for engagement with the contact carried by the casing upon radially expanding movement of the slip along said ramp, said ramp being stationary during said movement of said slip, said slip having additional means acting directly on said slip to draw it along said stationary ramp to cause said radially expanding movement, and said cooperable means being adapted to angularly align said contacts when the suspension head is seated in the casing.

6. Apparatus as defined in claim 5, wherein said casing includes an axially sliding door adapted to cover said internal contact, said slip being adapted to engage and move the door to expose the contact during radially expanding movement of the slip along said ramp.

7. Apparatus as defined in claim 5, wherein the suspension head includes two additional radially expandable and retractable slips, the slips being angularly spaced around the suspension head, the supply cable including three conductors each terminating in an electrical contact carried by one of said slips, and wherein said casing has two additional electrical contacts, the casing contacts being angularly spaced in conformity with the contacts carried by the slips, and said cooperable means is adapted to orient angularly the suspension head with respect to the casing upon the suspension head being inserted axially therein so that the respective contacts are in angular alignment in any one of three angular positions of the head in the casing.

8. Apparatus as defined in claim 7, wherein said cooperable means comprises lobed rings on the casing and head, respectively, each of said rings having three lobes.

9. Apparatus for energizing submergible pumping equipment in a well comprising a suspension head from which the equipment is adapted to be suspended and a casing adapted to be associated with wellhead apparatus for receiving the suspension head, the suspension head and casing having cooperable means for seating the head in the casing, the casing carrying at least one internal electrical contact element for establishing electrical connection between an external power source and a supply cable for the equipment carried by the suspension head, the suspension head having a ramp including a radially expandable and retractable slip adapted to move along said ramp, said supply cable terminating in an electrical contact carried by said slip for engagement with the contact carried by the casing upon radially expanding movement of the slip along said ramp and said cooperable means being adapted to angularly align said contacts when the suspension head is seated in the casing, said casing including an axially sliding door adapted to cover said internal contact, said slip being adapted to engage and move the door to expose the contact during radially expanding movement of the slip along said ramp, and means carried with the slip for exerting a pulling force on the door in a direction moving the door to cover said contact during radially retracting movement of the slip along said ramp.

* * * * *